US006119596A

United States Patent [19]

Fletcher et al.

[11] Patent Number: 6,119,596

[45] Date of Patent: Sep. 19, 2000

[54] PRE-INKED MARKING STRUCTURES AND METHOD OF ASSEMBLING SAME TO A STAMPED MOUNT

[75] Inventors: Eric G. Fletcher, Stirling; Steven J. Sculler, Morganville; Christopher M. Fisher, Port Monmouth; Frederick W. Dour, Basking Ridge, all of N.J.

[73] Assignee: M&R Marking Systems, Inc., Piscataway, N.J.

[21] Appl. No.: 09/129,485

[22] Filed: Aug. 4, 1998

Related U.S. Application Data

[60] Provisional application No. 60/054,655, Aug. 4, 1997.

[51] Int. Cl.[7] ..... B41K 1/50; B41K 1/56

[52] U.S. Cl. ..... 101/379; 101/405

[58] Field of Search ..... 101/128.4, 129, 101/333, 327, 405, 406, 109, 379

[56] References Cited

U.S. PATENT DOCUMENTS

| | | | |
|---|---|---|---|
| 4,212,839 | 7/1980 | Funahashi | 101/401.1 |
| 4,226,886 | 10/1980 | Lakes | 101/333 |
| 4,309,520 | 1/1982 | Blizzard | 525/477 |
| 5,582,105 | 12/1996 | Miki et al. | 101/125 |
| 5,829,352 | 11/1998 | Taira et al. | 101/327 |

FOREIGN PATENT DOCUMENTS

| | | | |
|---|---|---|---|
| 2197821 | 10/1986 | United Kingdom | 101/405 |

*Primary Examiner*—John S. Hilten
*Assistant Examiner*—Daniel J. Colilla
*Attorney, Agent, or Firm*—Lerner, David, Littenberg, Krumholz & Mentlik, LLP

[57] ABSTRACT

A microporous marking structure, a hand stamp and methods of manufacturing a hand stamp is disclosed. The microporous marking structure includes a noncontinuous pattern of sealed portions on the rear surface thereof. The microporous marking structure may be mounted for use in a pre-inked hand stamp which can be used to create numerous impressions without reinking.

19 Claims, 2 Drawing Sheets

PRE-INKED MARKING STRUCTURES AND METHOD OF ASSEMBLING SAME TO A STAMPED MOUNT

CROSS REFERENCE TO RELATED APPLICATION

This present application claims the benefit of U.S. Provisional Patent Application Ser. No. 60/054,655 filed on Aug. 4, 1997, the disclosure of which is hereby incorporated by reference herein.

FIELD OF THE INVENTION

The present invention pertains to microporous marking structures, hand stamps which use such microporous marking structures and methods of manufacturing such hand stamps.

BACKGROUND OF THE INVENTION

Microporous marking structures for use with hand stamps are typically made of various polymeric materials and resin (i.e., thermoplastic resin) or other open cell compositions which combine to form a slab-like structure having a large quantity of microscopic pores. The microporous structure is typically impregnated with ink or other suitable marking fluid which fill many of the microscopic pores.

Hand stamps having microporous marking structures are commercially known as pre-inked hand stamps since they can be used to create numerous impressions without requiring a user to introduce additional ink into the marking structure. This function is due to the microscopic size of the pores which allow the ink initially retained therein to escape at a controlled rate.

One brand of high quality pre-inked hand stamps is manufactured and sold by M&R Marking Systems, Inc. of Piscataway, N.J. under the trademark ROYAL MARK. These pre-inked marking structures are made from ROYAL MARK brand gel which comprises a mixture of thermoplastic resin and ink. This mixture is also known as pre-mix used for manufacturing microporous marking structures.

Various methods of manufacturing such microporous marking structures exist. When microporous structures for use with currently available ROYAL MARK pre-inked hand stamps are manufactured, the pre-mix, which includes a desired quantity of ink, is poured into a mold. The mold is then heated in a vulcanizer at a predetermined pressure and temperature for a selected period of time. When this procedure is completed, the marking structure is formed into a microporous slab and it may then be removed from the mold. Typically, excess ink is then removed from the marking structure by a process known as stabilizing.

Another known method of manufacturing microporous marking structures contemplates initially forming a microporous structure which does not contain ink. Such microporous structures may be manufactured by sintering, salt-leaching or other methods. M&R Marking Systems also manufactures and sells this type of marking structures and associated hand stamps under the trademark OPTIMARK. This type of microporous structure is then impregnated with ink during a separate procedure which may require immersing of the microporous marking structure in an ink pool, subjecting the microporous marking structure and ink to a vacuum environment or other known methods. With this type of marking structure, it is also usually required to stabilize the structure (i.e., remove excess ink therefrom) prior to assembly on a hand stamp mount.

Regardless of whether the microporous marking structures have been manufactured from gel material where ink is initially impregnated therein, or whether they are initially formed without ink, such microporous marking structures have traditionally been secured to a hand stamp mount by using mechanical holding devices, such as a ring or a ledge which hold the edges of the marking structure in assembled position on the stamp mount, or by an adhesive material such as a cynoacrylate adhesive or other types of solvent based adhesive material.

Both of these types of securing procedures (i.e., mechanical or chemical) have been associated with certain problems. For example, drawbacks associated with the use of mechanical mounting mechanisms is that such mechanisms are costly in that they require additional parts and usually require more time to manufacture.

Several drawbacks have also been associated with the use of adhesives. For example, when marking structures which are initially formed with ink are desired, it is often to difficult to select a suitable adhesive which will create an adequate bond to the "wet" rear surface of the marking structure. This problem has been overcome by using selected types of adhesives such as cynoacrylates which adhere to certain wet surfaces. However, the use of cynoacrylates also have drawbacks in that they require skill when being applied to a marking structure in order to avoid a problem known as "blooming" where the cynoacrylate material works its way through the rear surface of the marking structure toward the front surface thereof. The cynoacrylate adhesive could then potentially seal off certain areas near the front surface of the marking structure thereby creating ink transfer problems. Also, the ink within the microporous marking structure may prematurely dry out as a result of the blooming problem.

With regard to marking structures initially formed without ink impregnated therein, such as those formed by a salt leaching process or sintering, double sided self adhesive pressure sensitive tape has been used to secure such marking structures to hand stamp mounts. Typically, it is required to apply such tape to the rear surface of the microporous marking structure prior to introduction of ink therein. Ink is then introduced into the marking structure, and the marking structure is then secured to a mount. The problem with this arrangement is that certain types of inks may cause the adhesive tape to be compromised and thus, the marking structure may loose its bond with the associated stamp mount.

Problems have also arisen due to certain adhesives which do not adhere well to wet surfaces. In order to overcome such problems, hand stamp manufacturers have sealed the rear surface of the marking structure with sealant material. When microporous marking structures are formed with ink introduced therein as part of the manufacturing process, hand stamp manufacturers have had to contend with the messy process of coating the rear surface of the marking structure with a sealant prior to the application of a suitable adhesive for securing the marking structure to a hand stamp mount.

When using other types of microporous marking structures which are not initially formed with ink therein, the sealing procedure may also be performed. However, it has been found that when ink is introduced into a marking structure after the rear surface has been entirely sealed with an appropriate sealant material, a problem known as "curling" has occurred. This problem arises due to the inherent swelling of the marking structure which occurs after ink has been introduced therein.

SUMMARY OF THE INVENTION

The present invention overcomes the problems associated with the prior art by providing a marking structure, a hand stamp including such marking structure and a method of manufacturing hand stamps where the marking structure is only partially sealed at the rear surface thereof prior to being secured to a hand stamp mount.

In accordance with one aspect of the present invention, a marking structure is provided which comprises a microporous marking structure having a front surface adapted to imprint marking fluid onto a surface of an object. Typically, the front surface of the microporous marking structure will have indicia formed thereon. The microporous marking structure also comprises a rear surface having sealed portions thereon arranged in a noncontinuous pattern whereby marking fluid is precluded from flowing through the sealed portions of the rear surface.

The sealed portions of the marking structure may comprise various materials such as a polymer, a resin or other materials. The sealed portions may also include melted areas of the microporous marking structure itself formed by direct or indirect application of heat or other processes. In accordance with this aspect of the present invention, while it is important for the rear surface of the microporous marking structure to have noncontinuous sealed portions thereon, it should be appreciated that various materials or processes can be used to form the noncontinuous sealed portions while still falling within the scope of the present invention.

As used herein, the term "noncontinuous" sealed portions is intended to cover any pattern of sealant material, or sealed areas formed by heat or the like, applied to a rear surface of the marking structure where one or more areas are left unsealed on such rear surface. An unsealed area is one which is substantially porous so that marking fluid, such as ink, can be absorbed therein. A noncontinuous pattern of sealant material thus requires both sealed and unsealed areas on the surface of which can be contrasted with prior art sealant steps which require a continuous layer of sealant which rendered the entire rear surface of the microporous marking structure to be substantially nonporous.

The marking structure of the present invention may be formed by various microporous materials such as open celled sponge rubber, salt leached foam rubber and the like. Thus, the term "microporous" marking structure is intended to cover various types of marking structures which can be used in connection with hand stamps.

In accordance with another aspect of the present invention, a hand stamp is provided. The hand stamp uses the same type of microporous marking structure discussed above which has sealed portions arranged in a noncontinuous pattern on the rear surface of the marking structure. The hand stamp also comprises a mount on which the microporous marking structure is secured, and adhesive material arranged between the rear surface of the microporous marking structure and the mount which secures the microporous marking structure to the mount. In this embodiment, the adhesive material will preferably form a bond between the sealed portions on the rear surface of the microporous marking structure and the mount, but will not form substantial bonds between the unsealed portions on the rear surface of the microporous marking structure which are "wet" and the mount.

The noncontinuous pattern of sealed portions on the rear surface of the mount may be formed by a material which is the same as the adhesive material used to secure the microporous marking structure to the stamp mount.

In accordance with yet another aspect of the present invention, a method of manufacturing the hand stamp is provided. The method preferably comprises the step of manufacturing a microporous marking structure having a front surface and a rear surface. A pattern of noncontinuous sealed portions are then formed on the rear surface of the microporous marking structure and a marking fluid, such as ink, is then introduced into the microporous marking structure hereby the marking fluid can freely flow through the front surface of the microporous marking structure, but is precluded from flowing through the sealed portions on the rear surface thereof.

The method of manufacturing hand stamps also preferably comprises the step of securing the microporous marking structure to the mount. This step may be performed by applying adhesive material to either the mount or the noncontinuous sealed portions on the rear surface of the microporous marking structure so that the adhesive material can be said to be applied between the rear surface of the microporous marking structure and the mount.

Alternatively, the step of securing the microporous marking structure to the mount may comprise mechanically connecting the microporous marking structure to the mount without the use of adhesive material.

When adhesive material is used to secure the microporous marking structure to the mount, such adhesive material may only adheres substantially to the sealed portions on the rear surface of the microporous marking structure, and not to the other portions on the rear surface. The noncontinuous sealed portions may be formed by using the same type of adhesive material that is used to secure the microporous marking structure to the mount. However, it is preferable to allow the sealed portions to substantially cure before additional adhesive material is applied to secure the microporous marking structure to the associated hand stamp mount.

Various advantages are obtained by using the microporous marking structure of the present invention, the hand stamps which incorporate such microporous marking structure, and the present methods of manufacturing hand stamps. Such advantages are discussed hereinbelow.

DETAILED DESCRIPTION OF THE PREFERRED EMBODIMENTS

Figure 1:
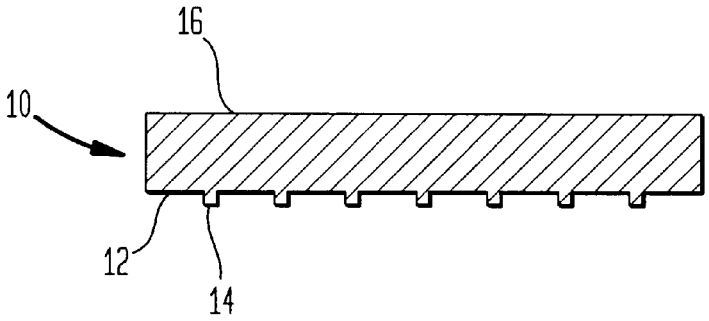
FIG. 1 is an isolated side cross sectional view of a microporous marking structure.
Figure 2:
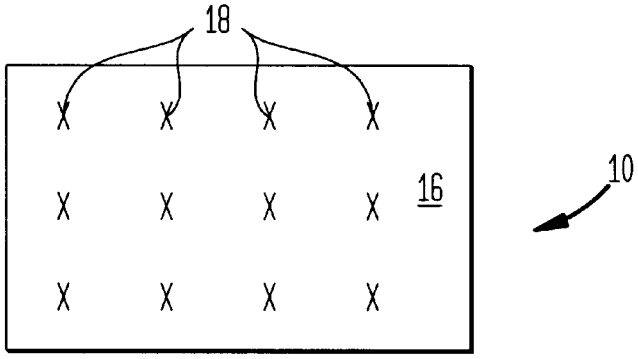
FIG. 2 is a top plan schematic view of a microporous marking structure illustrating the noncontinuous sealant pattern on a rear surface of the marking structure.
Figure 3:
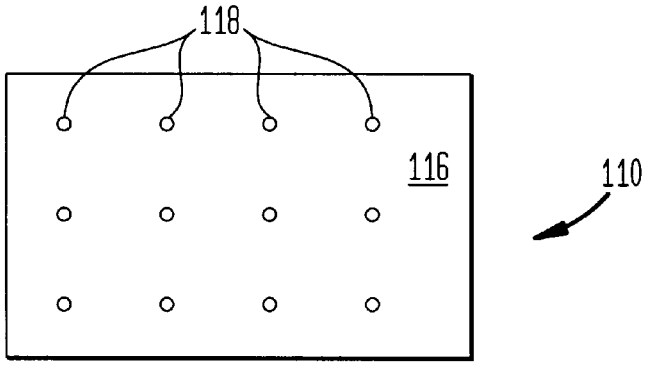
FIG. 3 is a second embodiment of a microporous marking structure illustrating the noncontinuous sealant pattern on a rear surface of the marking structure.

A microporous marking structure 10 including the novel and unobvious features of the present invention is shown in FIGS. 1–3. The microporous marking structure 10 includes a front surface 12 having raised indicia 14 thereon for creating a desired impression by transferring marking fluid, such as ink, retained therein to the surface of an object. The microporous marking structure 10 also includes a rear surface 16.

As illustrated schematically in FIG. 2, rear surface 16 includes a noncontinuous pattern of sealed portions 18 arranged thereon. The sealed portions 18 may comprise various resins, polymers, certain adhesive materials or the like. In a preferred embodiment, the sealed portions 18 may comprise a product manufactured by 3M known in the industry as 4475. This sealant material can be selectively applied to the rear surface 16 of the microporous marking structure 10 by various coating methods such as roll coating, manually applying by paint brushes with or without the use of a stencil, silk screening, or various other known coating techniques including knife coating, blade coating, air knife coating, reverse roll coating, gravure coating, transfer coating, hot melt coating, spray coating, calendaring, laminating, screen printing, lithographic printing, offset printing, letter press, flexography, pad printing, transfer printing, ink jet printing, thermography, and the like. The sealed portions 18 may be applied in a random pattern, or a selected noncontinuous pattern.

In one embodiment, selected portions of the front surface 12 of the microporous marking structure 10 may also be sealed and thus rendered impermeable to marking fluid. In such an embodiment, the raised indicia portions 14 will remain unsealed so that marking fluid can be transfered therefrom. In this embodiment the rear surface 16 will still include the noncontinuous pattern of sealed portions 18 shown in FIG. 2.

FIG. 3 schematically illustrates a second embodiment where a microporous marking structure 110 is shown having a rear surface 116 and sealed portions 118 thereon. In this embodiment, the noncontinuous pattern of sealed portions 118 may be formed by selectively melting portions of the microporous marking structure 110 by direct or indirect application of heat thereto, or by other processes. Thus, it should be appreciated that the sealed portions may comprise various compositions, or may simply comprise portions of the microporous marking structure itself which have been melted so as to render such portions impermeable to marking fluid retained within the microporous marking structure.

Figure 4:
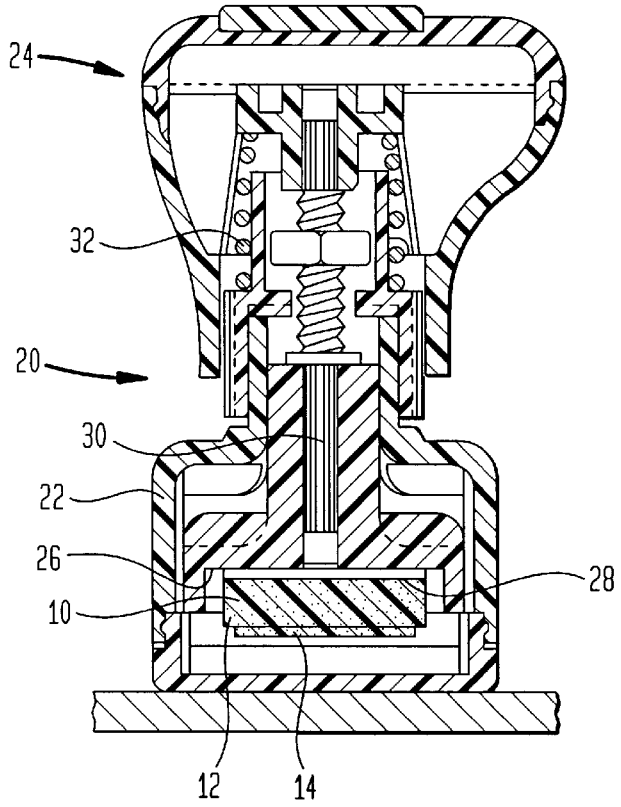
FIG. 4 is a side cross sectional view through a pre-inked hand stamp illustrating a microporous marking structure secured thereon.

A hand stamp 20 which incorporates the microporous marking structure 10 is shown in FIG. 4. As discussed hereinabove in the background of the invention section, high quality pre-inked hand stamps are commercially sold by M&R Marking Systems, Inc. under the trademarks ROYAL MARK and OPTIMARK.

The hand stamp 20 shown in FIG. 4 includes a frame 22, a handle 24, a platen mounted within the frame 22. The platen 26 includes a generally flat surface for receiving and securing the microporous marking structure 10 thereto. In the embodiment shown in FIG. 4, a layer of adhesive material 28 is arranged between the rear surface 16 of the microporous marking structure 10 and the surface of the platen 26. The noncontinuous pattern of sealed portions 18 which are also arranged on the rear surface 16 of the microporous marking structure 10 cannot be seen when the microporous marking structure 10 is in assembled position as shown in FIG. 4.

A stem 30 rigidly interconnects the platen 26 to the handle 24 while a spring 32 is arranged between the handle 24 and the frame 22 for biasing the handle 24 and thus, the microporous marking structure 10, to a rest position. When it is desired to create an impression on the surface of an object, such as paper or the like, a user would simply depress the handle 24 against the bias created by the spring 32 so that the indicia 14 arranged on the front surface 12 of the microporous marking structure 10 comes into contact with the surface of the object on which it is desired to create a marked impression.

An important difference between the hand stamp 20 and prior art hand stamps is that the microporous marking structure 10 has a noncontinuous pattern of sealed portions 18 on the rear surface 16 thereof. As indicated hereinabove, this allows marking fluid to permeate through the front surface 12 and the rear surface 16 of the microporous marking structure 10 except where the sealed portions 18 are arranged.

An advantage which is obtained by this construction is evident where the microporous marking structure 10 is initially formed without having ink impregnated therein. In this embodiment, the noncontinuous pattern 18 of sealant is applied to the rear surface 16 of microporous marking structure 10 prior to the introduction of ink therein. When ink is subsequently introduced into the microporous marking structure 10, the structure will swell without substantial distortion. Thus, the problem known as "curling" which may otherwise occur, where the rear surface 16 of the microporous marking structure 10 is entirely sealed is avoided.

This advantageous new structure will permit the microporous marking structure 10 to be sent directly to stamp manufacturers with sealed portions 18 thereon and without marking fluid therein. The stamp manufacturer may then introduce ink into the microporous marking structure prior to adhering the marking structure onto the platen 26 of hand stamp 20.

Another advantage obtained by applying a noncontinuous pattern of sealed portions 18 on the rear surface 16 of microporous marking structure 10 is that the marking structure can be re-inked from the rear surface thereof, even when assembled on a hand stamp, provided that the hand stamp includes reinking ports, or some other access to the rear surface 16 of the microporous marking structure 10. Traditionally, pre-inked hand stamps, such as hand stamp 20 have been reinked after many uses by introducing ink through the front surface 12 of the microporous marking structure 10.

When a sealant material is used to form the noncontinuous pattern of sealed portions 18 on the rear surface 16 of microporous marking structure 10, such sealant material may be the same as the adhesive material 28 used to secure the microporous marking structure 10 onto the platen 26 of the hand stamp 20. As indicated above, a suitable adhesive/sealant material is manufactured by 3M and is known in the industry as 4475. However, it should be understood that various types of sealants or adhesive materials may be used within the scope of the present invention.

Figure 5:
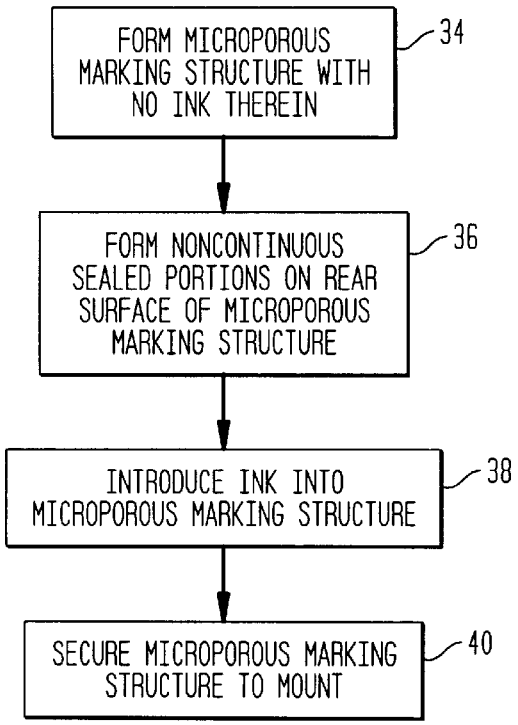
FIG. 5 is a flow diagram illustrating the steps of the present method of manufacturing a hand stamp.

A method of manufacturing hand stamps in accordance with another aspect of the present invention is generally shown in the flow chart of FIG. 5. This method requires the use of a microporous marking structure having a noncontinuous pattern of sealed portions on the rear surface thereof, such as microporous marking structures 10 and 110 of FIGS. 2 and 3, respectively.

As shown in FIG. 5, the initial step of manufacturing a hand stamp is shown in block 34 as forming a microporous marking structure where no ink is initially impregnated therein. In alternate embodiments, ink may be impregnated during manufacture of the microporous marking structure while remaining within the scope of the present invention.

As shown in block 36, a noncontinuous pattern of sealed portions 18 are then formed on the rear surface 16 of the microporous marking structure 10. As noted above, such sealed portions 18 may be formed by applying compatible polymers, resins, adhesives or the like. The sealed portions may also be formed by applying heat, either directly or indirectly, to the rear surface 16 of the microporous marking structure.

After the non-continuous pattern of sealed portions 18 are formed, ink is introduced into the microporous marking structure 10 as illustrated in block 38. This may occur by immersing the microporous marking structure in a pool of ink, or by placing the microporous marking structure with ink in a vacuum environment or by various other ink impregnating procedures. After ink has been introduced into the microporous marking structure 10, it is then secured to the hand stamp mount as noted in block 40.

In accordance with a preferred embodiment, the step of securing the microporous marking structure 10 to the hand stamp mount may comprise applying adhesive material 28 between the rear surface 16 of the microporous marking structure 10 and the surface of a corresponding platen 26. In one embodiment, the adhesive may only adhere to the sealed portions 18 of the microporous marking structure 10 and to the platen 26 on which the microporous marking structure 10 is secured. The remaining unsealed areas on the rear surface 16 of the microporous marking structure 10 will be free from adhesive material 28 and may thus permit reinking of the microporous marking structure 10 through the rear surface 16 thereof even after the microporous marking structure 10 is arranged in assembled position on a hand stamp mount.

In accordance with other methods of manufacturing hand stamps, the microporous marking structure 10 may be mechanically secured to the platen 26 of the hand stamp 20 and thus, no additional adhesive material 28 would be required.

It should be appreciated that various modifications to the microporous marking structure of the present invention and to the hand stamp including such microporous marking structure and to the steps of the method of manufacturing microporous marking structures can be made in accordance with the description set forth hereinabove while remaining within the scope of the present invention. Indeed, such modifications are encouraged to be made as the scope of the present invention is limited only by the claims set forth below.

We claim:

1. A hand stamp comprising:

a microporous marking structure retaining a marking fluid therein said microporous structure having a front surface adapted to imprint marking fluid onto a surface of an object, and a rear surface having sealed portions arranged thereon in a noncontinuous pattern whereby marking fluid within said microporous marking structure can flow through portions of said front surface, but is precluded from flowing through said sealed portions of said rear surface; and a mount on which said microporous marking structure is secured, said noncontinuous pattern of sealed portions being a part of said rear surface of said microporous marking structure prior to securing said microporous marking structure to said mount.

2. The hand stamp of claim 1 wherein said sealed portions comprise a polymer arranged on said rear surface.

3. The hand stamp of claim 1 wherein said sealed portions comprise a resin arranged on said rear surface.

4. The hand stamp of claim 1 wherein said sealed portions comprise melted areas of said microporous marking structure on said rear surface.

5. The hand stamp of claim 1 wherein said microporous structure comprises open celled sponge rubber.

6. The hand stamp of claim 1 wherein said microporous structure comprises salt leached foam rubber.

7. A hand stamp comprising:

a microporous marking structure retaining a marking fluid therein, said microporous marking structure having a front surface adapted to imprint the marking fluid onto a surface of an object, and a rear surface having sealed portions arranged thereon in a noncontinuous pattern whereby said marking fluid within said microporous marking structure can flow through said front surface to create an imprint on the surface of an object, but is precluded from flowing through said sealed portions of said rear surface;

a mount on which said microporous marking structure is secured; and adhesive material arranged between said rear surface of said microporous marking structure and said mount for securing said microporous marking structure to said mount, said adhesive material forming a bond between said sealed portions and said rear surface and said mount.

8. The hand stamp of claim 7 wherein said sealed portions comprise a polymer arranged on said rear surface of said microporous marking structure.

9. The hand stamp of claim 7 wherein said sealed portions comprise a resin arranged on said rear surface of said microporous marking structure.

10. The hand stamp of claim 7 wherein said sealed portions comprise melted areas of said microporous marking structure arranged on said rear surface.

11. The hand stamp of claim 7 wherein said microporous marking structure comprises open celled sponge rubber.

12. The hand stamp of claim 7 wherein said microporous marking structure comprises salt leached foam rubber.

13. The hand stamp of claim 7 wherein said sealed portions comprises a material which is the same as said adhesive material.

14. A method of manufacturing a hand stamp comprising the steps of:

manufacturing a microporous marking structure having a front surface and a rear surface;

forming sealed portions in a noncontinuous pattern on said rear of said microporous marking structure prior to securing said microporous marking structure to amount of the hand stamp; and introducing a marking fluid into said microporous marking structure after said noncontinuous sealed portions are formed whereby said marking fluid can freely flow through said front surface of said microporous marking structure but is precluded from flowing through said sealed portions on said rear surface.

15. The method of claim 14 further comprising the step of securing said microporous marking structure to a mount of said hand stamp.

16. The method of claim 15 wherein said step of securing said microporous marking structure to said mount comprises applying adhesive material between said rear surface of said microporous marking structure and said mount.

17. The method of claim 16 wherein said adhesive material only adheres substantially to said sealed portions on said rear surface of said microporous marking structure.

18. The method of claim 15 wherein said step of securing said microporous marking structure comprises mechanically connecting said microporous marking structure to said mount without using adhesive material.

19. The method of claim 16 wherein said noncontinuous sealed portions are formed using an adhesive material, and said step of securing said microporous marking structure to said mount comprises using the same adhesive material after the adhesive material used to form said noncontinuous sealed portions is cured on said rear surface of said microporous marking structure.

* * * * *

UNITED STATES PATENT AND TRADEMARK OFFICE

CERTIFICATE OF CORRECTION

PATENT NO. : 6,119,596
DATED : September 19, 2000
INVENTOR(S) : Fletcher et al.

It is certified that error appears in the above-identified patent and that said Letters Patent is hereby corrected as shown below:

Title page,

ABSTRACT,
Line 2, "is" should read -- are --.
Line 7, "reinking" should read -- re-inking --.

Column 1,
Line 28, "fill" should read -- fills --.

Column 2,
Line 26, "to" should read -- too --.
Line 31, "have" should read -- has --.
Line 44, "double sided" should read -- double-sided --.
Line 44, "self adhesive" should read -- self-adhesive --.

Column 4,
Line 48, "adheres" should read -- adhere --.
Line 66, "cross sectional" should read -- cross-sectional --.

Column 5,
Line 7, "cross sectional" should read -- cross-sectional --.

Column 7,
Line 2, "reinking" should read -- re-inking --.
Line 5, "reinked" should read -- re-inked --.
Line 63, "reinking" should read -- re-inking --.

Column 8,
Line 20, after "therein" insert -- , --.
Line 42, "open celled" should read -- open-celled --.

UNITED STATES PATENT AND TRADEMARK OFFICE

CERTIFICATE OF CORRECTION

PATENT NO. : 6,119,596
DATED : September 19, 2000
INVENTOR(S) : Fletcher et al.

It is certified that error appears in the above-identified patent and that said Letters Patent is hereby corrected as shown below:

Column 9,
Line 8, "open celled" should read -- open-celled --.
Line 13, "comprises" should read -- comprise --.
Line 20, after "rear" insert -- surface --.
Line 21, "amount" should read -- a mount --.

Signed and Sealed this

Eighth Day of January, 2002

*Attest:*

*Attesting Officer*

JAMES E. ROGAN
*Director of the United States Patent and Trademark Office*